United States Patent [19]

Cherish et al.

[11] 4,282,010

[45] Aug. 4, 1981

[54] FLUIDIZED BED INJECTION ASSEMBLY FOR COAL GASIFICATION

[75] Inventors: Peter Cherish, Bethel Park; Louis A. Salvador, Hempfield Township, Westmoreland County, both of Pa.

[73] Assignee: The United States of America as represented by the United States Department of Energy, Washington, D.C.

[21] Appl. No.: 58,237

[22] Filed: Jul. 17, 1979

[51] Int. Cl.[3] ..... C10J 3/68

[52] U.S. Cl. ..... 48/77; 34/57; 48/63; 48/86 A; 209/140; 422/145

[58] Field of Search ..... 422/145; 48/63, 77, 48/64, 73, 76, 180 F, 180 B, 86 A; 34/57 A; 110/243, 244, 245, 263; 201/31; 209/138, 139 R, 140, 141

[56] References Cited

U.S. PATENT DOCUMENTS

| | | | |
|---|---|---|---|
| 3,804,606 | 4/1974 | Archer et al. | 48/63 |
| 3,847,563 | 11/1974 | Archer et al. | 48/63 |
| 3,861,862 | 1/1975 | Steever et al. | 34/57 A |
| 4,021,193 | 5/1977 | Waters | 34/57 A |
| 4,152,843 | 5/1979 | Kemmetmueller | 34/57 A |
| 4,173,189 | 11/1979 | Cooper | 110/263 |

FOREIGN PATENT DOCUMENTS

| | | | |
|---|---|---|---|
| 963456 | 2/1975 | Canada | 34/57 A |

OTHER PUBLICATIONS

Archer et al., "The Westinghouse Fluidized Bed Process," Oct. 10, 1978.

Salvador et al., "Process Development for the Westinghouse Advanced Fluidized Bed Coal Gasification System."

"Advanced Coal Gasification System for Electric Power Generation," by Westinghouse Electric Corp., 1977.

*Primary Examiner*—S. Leon Bashore
*Assistant Examiner*—Michael Goldman
*Attorney, Agent, or Firm*—Edward L. Levine

[57] ABSTRACT

A coaxial feed system for fluidized bed coal gasification processes including an inner tube for injecting particulate combustibles into a transport gas, an inner annulus about the inner tube for injecting an oxidizing gas, and an outer annulus about the inner annulus for transporting a fluidizing and cooling gas. The combustibles and oxidizing gas are discharged vertically upward directly into the combustion jet, and the fluidizing and cooling gas is discharged in a downward radial direction into the bed below the combustion jet.

1 Claim, 5 Drawing Figures

FLUIDIZED BED INJECTION ASSEMBLY FOR COAL GASIFICATION

GOVERNMENT CONTRACT

The invention described herein was made or conceived in the course of, or under, a contract with the United States Department of Energy.

BACKGROUND OF THE INVENTION

1. Field of the Invention

This invention relates to fluidized bed coal gasification reactors, and more particularly to arrangements for feeding fluid, including particulate mediums, into the reactor.

2. Description of the Prior Art

One of the most promising forms of energy utilization is gasification of coal. A particularly promising approach in the use of fluidized beds in the gasification process, for example, as discussed in U.S. Pat. Nos. 3,804,606 and 3,847,563.

Among the mediums fed into the fluidized bed reactors are solid combustibles in a transport gas, a combustion gas, and a fluidizing gas which can be used in addition to the other gases for fluidization. The solid combustibles include char fines, coke or pulverized coal, carried into the reactor by a transport gas which can include steam, air, nitrogen, carbon dioxide or recycled product gas. The combustion gas is typically oxygen or air and the fluidizing gas can include steam or recycle gas which also assists in the combustion process.

In the prior art, air and steam have typically been injected into the reactor vessel either radially or axially through a central tube. The solid combustibles, such as char fines, have been directed radially, from the side of the reactor vessel, into the fluidized bed, or vertically from the upper portions of the reactor vessel. Additionally, separate sparger rings have been utilized to increase fluidization in selected areas, particularly the lower regions of the bed. Ash is removed from the lower end of the reactor, and a product gas is discharged at the upper end.

While these arrangements achieve desired gasification, improvements can be made. For example, the prior art systems are subject to plugging at the ash exit by large, two to ten inch diameter clinker-type material formed from a defluidized zone at the air tube outlet or by slugging, the formation of excessively large bubbles causing an exchange of hot and cold particles in the upper section of the reactor bed. Additionally, the effect of radial impingement of the solid combustibles and transport gas upon the combustion jet can influence the length and shape of the jet resulting in undesirable clinker formation and potential plugging of the discharge system. An auxiliary fluidizing means in addition to, or alternative to, the sparger rings, can be desirable to assure sufficient mixing of the particles and recirculation of the solids in the zone of the combustion jet.

It is therefore desirable to provide configurations for feeding the reactant mediums into the fluidized bed reactor vessel which improve upon prior systems.

SUMMARY OF THE INVENTION

This invention provides improved inlet configurations for the mediums entering a fluidized bed reactor which improve upon the above-discussed considerations. In preferred form the configuration includes three concentric vertical tubes entering the bottom of a fluidized bed coal gasification reactor vessel. Solid combustibles, such as char fines or pulverized coal, which can include highly caking coals, in a transport gas, flow upwardly through the innermost tube, and are discharged at the open upper end of the tube, directly into the combustion jet. An intermediate tube, generally coextensive with the inner tube, concentrically surrounds the inner tube so as to form an inner annulus. The primary oxidizing gas, such as air, oxygen or steam, is injected throgh this annulus, which is also open at its upper end, directly into the combustion jet.

Concentrically surrounding the intermediate tube is an outer tube extending upwardly to an elevation below that of the inner and intermediate tubes. An outer annulus is formed between the outer and intermediate tubes. This annulus is sealed at its upper end and the upper portion of the outer tube is perforated so as to allow radial discharge of a fluidizing and cooling gas, such as steam or recycle gas.

The exterior of the inner tube is preferably provided, at its upper end, with a number of radially extending fins which, by providing a centering means and flow straightening, assure an even distribution of solids feed materials and oxidizing gases into the jet.

The structure for sealing the top of the outer annulus preferably includes a truncated conical transition affixed to the top of the outer tube and forming a slip fit with the intermediate tube so as to accommodate differential thermal expansion. The truncated transition forms an angle, with respect to the horizontal, of at least 50°, to ensure that fluidized particles will not stagnate, adhere and form clinkers upon the transition outer surface.

A seal ring extends outwardly from the circumference of the intermediate tube toward the inside of the outer tube. A sealing packing is provided between the seal ring and the top of the outer annulus, preventing discharge of the fluidizing and cooling medium through the slip fit.

The perforations in the outer tube are disposed below the seal ring and packing, and are oriented to discharge the fluid medium at a downward angle, preferably approximately 30°with respect to the horizontal, to boost the gas flow in the annulus and enhance local fluidization in the upper region of the reactor feed system.

BRIEF DESCRIPTION OF THE DRAWINGS

The advantages, nature and additional features of the invention will become more apparent from the following description, taken in connection with the accompanying drawings, in which.

DESCRIPTION OF THE PREFERRED EMBODIMENTS

Figure 1:
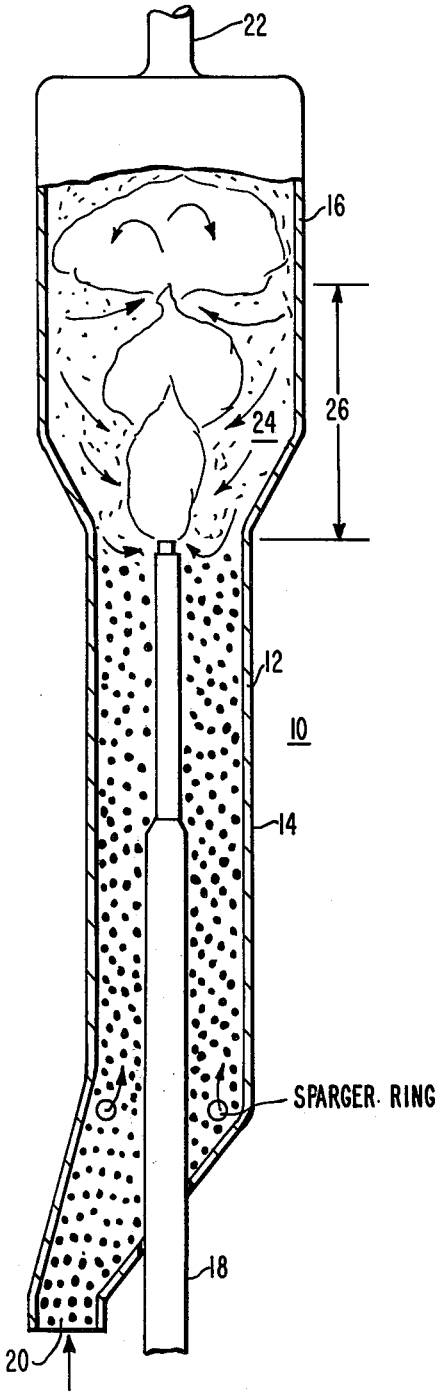
FIG. 1 is a partial cross section view, in elevation, of a fluidized bed gasification reactor in accordance with the invention.

Referring now to FIG. 1 there is shown a fluidized bed reactor 10 including a vessel 12. The vessel 12 is generally cylindrical including a lower body 14, an enlarged upper body 16, an inlet feed system 18, an ash outlet 20 at the bottom, and a product gas outlet 22 at the top.

Char particles and other mediums enter the vessel 12 through the feed system 18 forming a recirculating fluidized bed 24 wherein the char is combusted with air or oxygen and gasified with steam producing a combustible product gas and waste ash. FIG. 1 also depicts the combustion jet penetration depth 26 shown as extending from the top of the feed system 18 to an area in which slugging operational characteristics may occur as a result of enlarged bubble formation which can attain the dimension of the inner diameter of the vessel. It is desirable to enhance penetration depth, the overall penetration jet volume, and the time period during which the particulate matter exists within and immediately above the combustion jet in order to ensure complete combustion of the char. It has been found that this condition is enhanced when the annular velocity is between one and two times the minimum fluidization velocity, $U_{mf}$, of the solids in the annulus and the jet velocity is 60 ft./sec. or greater.

Figure 3:
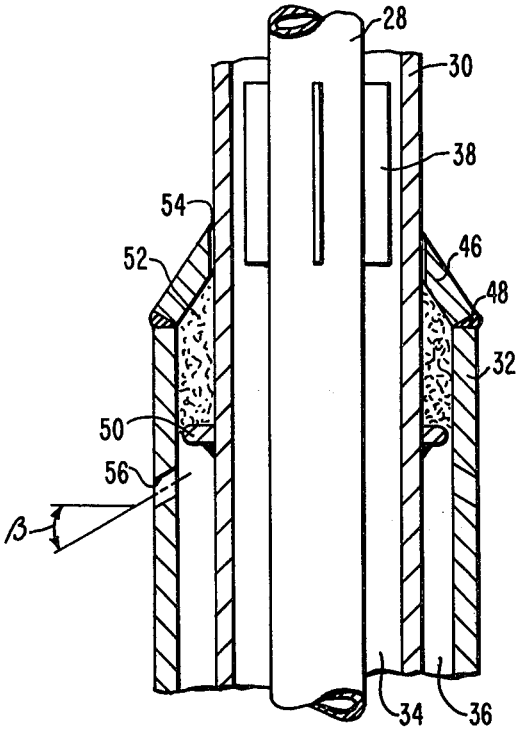
FIG. 3 is an elevation view, partially in cross section of the upper portion of the feed system of FIG. 2.
Figure 2:
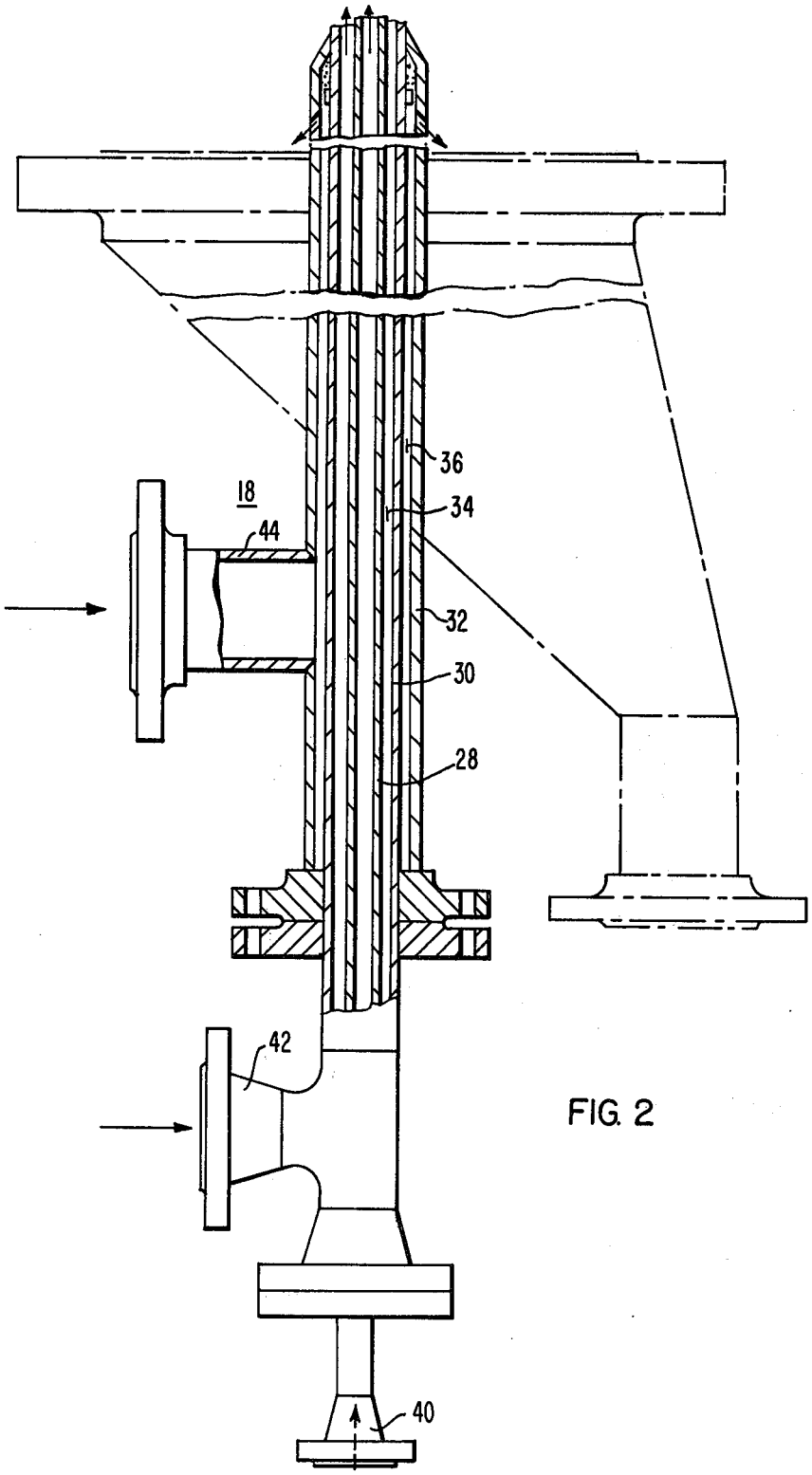
FIG. 2 is a cross-sectional view, in elevation, of a coaxial feed system for the reactor of FIG. 1.

FIGS. 2 and 3 show additional details of the feed system 18. It is arranged so as to provide a combined coaxial feed, and a combined coaxial and radial discharge of fluid mediums, particularly providing coaxial vertical upward feed for char or coal particles in a transport gas. The primary structures include three tubular members, an inner tube 28, an intermediate tube 30, and an outer tube 32, respectively surrounding one another radially so as to form an inner annulus 34 and an outer annulus 36. The tubes are preferably concentric. In preferred form for a one-half ton per hour unit, the inner tube 28 is a 1-inch schedule 40 pipe of Incoloy 800. Radially extending from the tube 28, into the intermediate annulus 34, are a plurality, preferably four, spacer plates 38, 7/16 inch wide by 2½ inch long of type 316 stainless steel. Char fines or coals in a transport gas, which can comprise recycled product gas, steam, air, nitrogen and carbon dioxide, enter the inner tube through nozzle 40 and are injected into the reactor vessel 12 through the open top of the inner tube 28 at a temperature in the range of 500° F. The spacer plates 38 provide for an even distribution at the upper end of the inner annulus. The solid feeds are thus discharged upwardly directly into the combustion jet.

The intermediate tube 30 is a 2½-inch schedule 40S pipe of type 316 stainless steel. An oxidant, such as air or oxygen, enters the inner annulus 34 through an inlet nozzle 42, and also flows upwardly into the combustion jet through the open upper end of the annulus 34.

Figure 4:
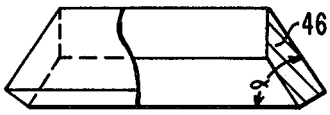
FIG. 4 is a cross sectional view of a transition piece in accordance with the invention; and, FIG. 5 is a cross-sectional view of a seal ring in accordance with the invention.
Figure 5:
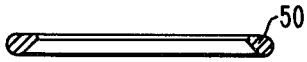

A cooling and fluidization booster medium, such as steam or air, enters the outer annulus 36 through inlet nozzle 44 and flows upwardly, coaxially with the solids feed and oxidant. The top of the outer annulus 36 is sealed by structure including a truncated conical transition member 46, shown in FIG. 4. The transition member, type 304 stainless steel, is affixed to the top of the 4-inch schedule 80S outer tube by weld 48. The inside diameter of the upper end of the transition member is 2⅞ inches, so as to form a slip fit with respect to the intermediate tube 30. The slip fit allows for differential thermal expansion among the components without generation of undue stresses. The outer side of the transition member is shaped to provide a steep slope, the angle $\alpha$ being preferably greater than 50°. This ensures that particulate matter does not stagnate on the outer surface.

Affixed to and surrounding the radial periphery of the intermediate tube 30 is a seal ring 50. The seal ring is comprised of type 316 stainless steel having an outside diameter of 3¾ inches. Between the seal ring 50 and the transition 46 is a packing material 52, such as a temperature resistant refractory fibre blanket, which forms a pressure seal so that the cooling and booster fluidization medium cannot escape through the gap 54 resulting from the slip fit.

The outer tube 32 is provided with perforations 56 through which the steam or recycle gas is radially discharged into the reactor. The perforations 56 are downwardly sloped, preferably at an angle, $\beta$, of approximately 30° with respect to the horizontal. In this manner the steam or recycle gas, injected into the outer annulus at approximately 450° F., provides not only cooling of the intermediate tube, but also booster fluidization to particulate matter in the lower body 14.

It will now be apparent that the disclosed arrangement provides direct injection of the char fines into the high energy jet penetration zone, providing improved combustion. The configuration further provides the ability to inject particulate coal, without pretreatment, through the inner tube, alternative to, or in combination with, injection of char. Since the particulate coal is surrounded by an oxidant as it enters the high energy jet region, the outer surface of the coal particles is rapidly oxidized, preventing agglomeration, thus eliminating the need for a separate decaking pretreatment of the coal.

Additionally, the downward injection of the steam prevents formation of an enlarged fixed bed in the lower body 14, boosting fluidization and upward stripping flow of char into the high energy zone while allowing downward motion and eventual withdrawal of ash through the outlet 20. And, the coaxial feed system provides separate flow rate control of each of the three input mediums, allowing adjustment to the optimum conditions for each reactor.

Since numerous changes can be made in the above-described apparatus without departing from the spirit and scope thereof, it is intended that all matter contained in the foregoing description or shown in the accompanying drawings shall be interpreted as illustrative and not in a limiting sense.

We claim:

1. In a fluidized bed coal gasification reactor system including an elongated vertically disposed vessel having a cylindrical lower body and an enlarged cylindrical upper body, and a sparger ring disposed at the lower end of said lower body, wherein solid combustibles in a transport gas, an oxidizing gas and a fluidization and cooling gas flow into said vessel to intermediately produce char and ultimately produce a combustible product gas and ash, the improvement comprising:

(a) means for transporting said combustibles and transport gas, said means including a fixed vertical inner tube extending upwardly into said vessel and being open at its upper discharge end;

(b) means for transporting said oxidizing gas, said means for transporting said oxidizing gas including a fixed vertical intermediate tube extending upwardly into said vessel and surrounding said inner tube so as to form an inner annulus, said intermediate tube being open at its upper discharge end; and, (c) means for transporting said fluidizing and cooling gas, said means for transporting said fluidizing and cooling gas including a fixed vertical outer tube extending upwardly into said vessel and having a tubular wall, said outer tube surrounding said intermediate tube so as to form an outer annulus, said outer tube having means for sealing its upper end and means for radially discharging said fluidizing gas said sealing means comprising a truncated conical transition between said outer tube and said intermediate tube, said transition forming a slip fit with respect to said intermediate tube, a seal ring affixed radially about the exterior of said intermediate tube, and a packing disposed within said outer annulus above said sealing ring, said packing completely filling the volume of said outer annulus bounded by said seal ring and said truncated conical transition, said radial discharge means including apertures disposed radially through said tubular wall at an elevation within said lower body above said sparger ring.

* * * * *